US006635833B2

(12) United States Patent
Vignaud

(10) Patent No.: US 6,635,833 B2
(45) Date of Patent: Oct. 21, 2003

(54) LIMIT SWITCH

(75) Inventor: Jean-Claude Vignaud, Saint Yrieix (FR)

(73) Assignee: Schneider Electric Industries SA (FR)

( * ) Notice: Subject to any disclaimer, the term of this patent is extended or adjusted under 35 U.S.C. 154(b) by 0 days.

(21) Appl. No.: 10/060,217

(22) Filed: Feb. 1, 2002

(65) Prior Publication Data

US 2002/0104744 A1 Aug. 8, 2002

(30) Foreign Application Priority Data

Feb. 7, 2001 (FR) ..... 01 01744

(51) Int. Cl.[7] ..... H01H 9/02
(52) U.S. Cl. ..... 200/47; 200/293; 200/302.1
(58) Field of Search ..... 200/47, 61.41, 200/61.42, 293, 302.1, 303

(56) References Cited

U.S. PATENT DOCUMENTS 3,578,932 A * 5/1971 Holmes ..... 200/302.1
4,133,991 A * 1/1979 Takase ..... 200/47
4,556,768 A * 12/1985 Atsumi et al. ..... 200/302.2
4,788,387 A * 11/1988 Kasegi et al. ..... 200/47
4,847,453 A * 7/1989 Newell et al. ..... 200/47
5,593,021 A * 1/1997 Chwieralski et al. ..... 200/303

FOREIGN PATENT DOCUMENTS

WO WO 99/27551 6/1999 ..... H01H/9/02

* cited by examiner

*Primary Examiner*—Michael Friedhofer
(74) *Attorney, Agent, or Firm*—Parkhurst & Wendel, L.L.P.

(57) ABSTRACT

A proximity detection switch, including a housing with a switching block controlled by a sensor component contained therein and housing connection elements for external connection via a cable, the body and a removable cover each having a flange part for cooperatively forming a flange that defines a sealed aperture for a cable to pass therethrough. The device further includes a detachable cable-entry coupling for sliding engagement with the body along a direction approximately perpendicular to the plane of the bottom wall of the body.

9 Claims, 1 Drawing Sheet

LIMIT SWITCH

FIELD OF THE INVENTION

The present invention relates to a movement or proximity detection switching device, including a sensitive component to carry out this detection, and a body defining a housing for a switch assembly controlled by the sensitive component and connected to the outside via an electrical connection cable, the housing being closed by a removable cover.

Description of Prior Art

Limit or safety switches for industrial use are well known (for example XCK-J products, see Telemecanique catalogue "Limit switches", April 1999). Cabling the contact block of such devices is difficult and the different devices in a range require different casings when it is required to connect to these casings cables of different diameters or to add to these casings cable entries equipped with different threads.

The document WO-99/27 551 shows a limit switch wherein the body and the cover each have a threaded half flange to receive a maiden nut of a seal coupling. The effect of tightening the nut is to distort or reposition the cover, which corrupts the seal qualities of the device.

SUMMARY OF THE INVENTION

The purpose of the invention is to make it easier to assemble and to cable, in the body of such devices, a switching block equipped with connection elements, ensuring the assembly is well sealed, while allowing cables of different diameters or couplings with different characteristics to be used without modifying the body.

According to the invention, the detachable cable entry coupling is introduced by means of fitting elements, by a sliding movement along a direction approximately perpendicular to the main wall of the cover, in guiding and holding means provided in the body. It is possible in this way to add to a same device body couplings which are differentiated by their internal diameter or by their thread type.

The guiding and holding means of the body are preferably rectilinear and the fitting elements of the coupling form a frame fitted on its sides with insertion means complementing the guiding and holding means, the switching block and the coupling being introduced into the device body in a same direction. The frame is to advantage symmetrical, located at the end of the coupling and housed partly in the housing of the switching block and partly in guiding and holding means provided in the cover.

The coupling carries an external seal and the cover is mounted on the body by means of pivoting elements, preferably hooks, provided near one end and has at the other end a screw for fixing to the body, the pivoting elements being offset relative to the plane of the main wall of the cover so as to increase the tightening torque of the seal.

BRIEF DESCRIPTION OF THE DRAWINGS

The description will be given below of a non-restrictive embodiment of the invention, in relation to the appended drawings.

DESCRIPTION OF THE PREFERRED EMBODIMENTS

Figure 1:
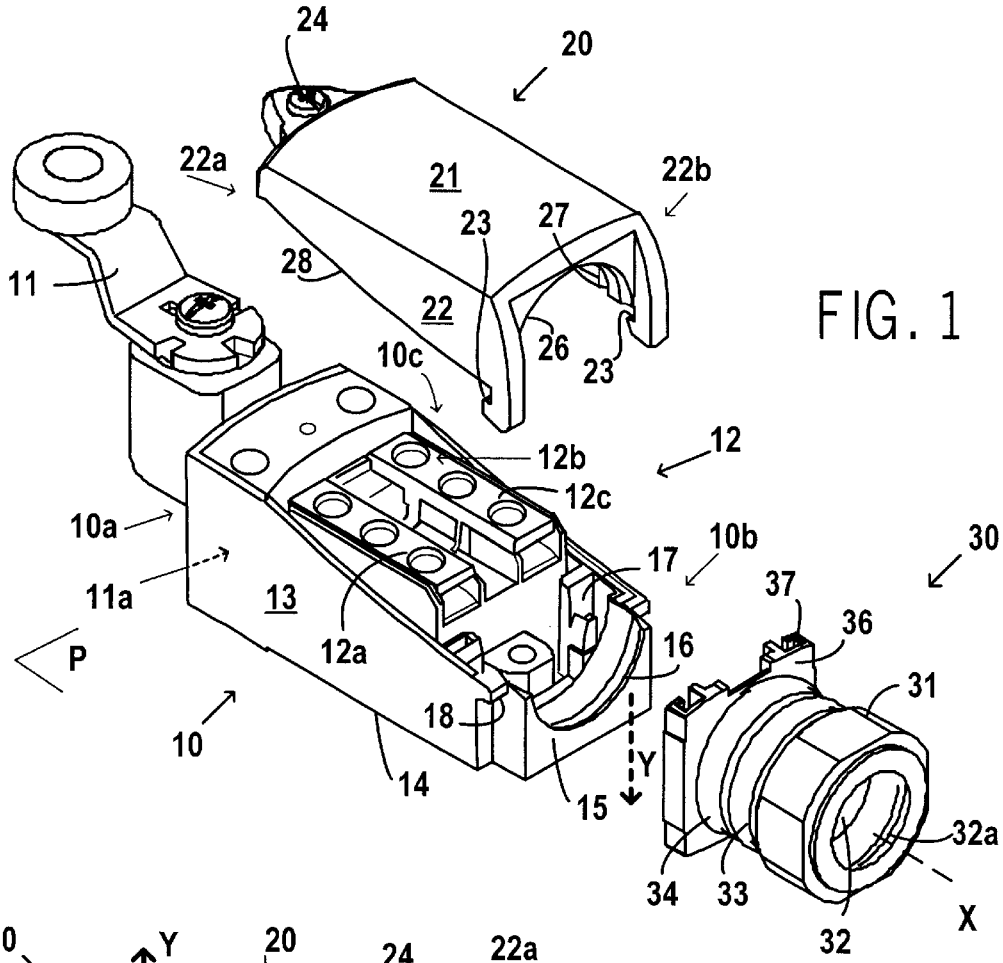
FIG. 1 shows in perspective a limit switch according to the invention.

The switching device shown in the figures is a limit switch, which includes a body 10 and, as a component sensitive to the movement of an object, a pivoted lever assembly 11 fixed to the body near a first end 10*a* of the latter. The body is parallelepiped in general shape and defines near this end 10*a* a housing 11*a* to receive a part of the assembly 11; the body also defines in its intermediate part 10*c* a housing 12*a* to receive, by insertion along a direction Y, a detachable switching block 12 which is activated by the assembly 11, the housing 12*a* normally being closed by a cover 20. The switching block 12 has mechanical or electronic switching elements and it is connected to a component or circuit external to the device by means of connection elements 12*b* to which are connected conductors collected into a cable C (see FIG. 2) which is held by a coupling 30 itself fixed to the body 10 towards a second end lob of the latter. The block 12 has towards the top (FIGS. 1 and 2) a snap-on wafer 12*c,* which conceals the connector area after cabling. The body 10, the cover 20 and the coupling 30 are made of an insulating or metal material.

The body 10 of the device has approximately plane lateral walls 13 and a plane bottom wall 14 of plane P which delimit the housing 12*a*. At the end lob, the body 10 has a wall 15 for the cable C to pass through. The wall 15 has a semicircular cut-out which forms a half flange 16 to constitute a channel for the cable C. Towards the inside of the body relative to the flange are provided rectilinear means 17 for guiding and holding the coupling, for example grooves and/or ribs orientated perpendicular to the plane P of the bottom wall 14 (vertical in the figures).

A cover 20 is fixed to the body so as to close the aperture through which the switching block 12 is introduced. It includes a main closure wall 21, which is plane or skew, extending approximately parallel to the plane P of the rear surface 14, so as to cover the housing 12*a*.

Figure 2:
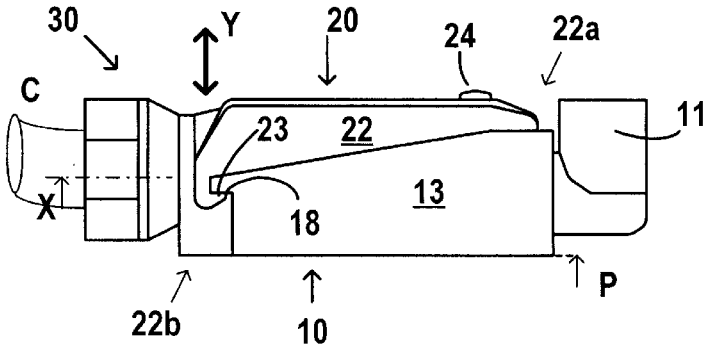
FIG. 2 is a side view on a smaller scale of the switch.
Figure 3:
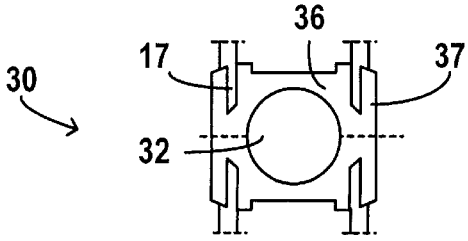
FIG. 3 shows in elevation the removable coupling of the switch.

The cover 20 has transverse walls 22 which become narrower from its foot end 22*b*, which is close to lob, towards its head end 22*a*, which is close to 10*a*. The walls 22 have for example a general trapezoidal or triangular shape and each end in a hook 23 intended to be supported on the body by engaging with a grip 18 provided in a lateral wall 13 of the body at a significant distance from the wall 21, for example halfway between the walls 21 and 14. Instead of hooks 23, snap-on pivots may be provided. The grips 18 are located nearer the wall 15 than the means 17 and below the axis X (FIG. 2). In the middle of its head end 22*a*, the cover 20 has a hole intended for a screw 24, this screw engaging with a tapped hole of the body so as to provide the fixing of the cover.

The cover 20 has a wall fitted with a semi-circular cut-out which forms a half flange 26 complementing the half flange 60 of the body 10. Rectilinear means 27 for guiding and holding the coupling 30 (vertical in the figures), for example symmetrical with the means 17 relative to the assembly drawing, are provided inside the cover. Moreover, the cover 20 carries on its periphery a bi-injected seal bead 28 intended to engage with the upper edge of the body which edges the housing 12.

The coupling 30 has a body 31 with a general revolution shape equipped with a partly threaded channel 32 of axis X to receive the cable C and a fitting not shown providing the local seal round the cable. The fitting is put under pressure by a component not shown which is screwed into the threaded part of the channel 32.

The coupling has a cylindrical part adapted to the half flanges 16, 26 with an external groove 33 in which is housed a sealing O-ring 34, which seal engages therefore with the half flanges; in its part intended to be housed inside the body

10, the coupling 30 has an assembly frame 36 approximately square or rectangular. The flange 36 forms a symmetrical frame provided on its sides with rectilinear insertion means 37 (for example ribs and/or grooves) complementing the means 17 in the body so as to allow a detachable assembly of the coupling. The means 37 engage with the means 17, 27 by fitting; the means in question may have a snap-on or hard friction effect added to the fitting effect.

The couplings 30 may thus differ in their part holding the cable and/or in their cable gland threading while preserving a part integrated with the body, particularly an assembly flange 36, which remains unchanged. The symmetrical H-shape of the frame makes it possible to assemble it in the body in two positions offset to 180° and to obtain a similar fitting in the body and in the cover.

Cabling the switching block 12 can be comfortably carried out when the block has been introduced along the direction Y perpendicular to the bottom wall 14 inside its housing 12*a* of the body 10. The coupling 30 of the type suitable for the cable, and engaged on the cable, is then slid into the means 17 along the same direction Y, with contact made between the seal and the half flange 16. The cover 20 is engaged by its hooks 23 onto the grips 18 and by its means 27 onto the means 37 of the coupling, then is set to pivot around these grips, whereas the O-ring 34 is supported on the half flange 26. Tightening the single fixing screw 24 allows the seal 34 to be put under pressure, and for this to be done with a force which is increased by offsetting the hooks 18 relative to the plane P of the wall 21 of the cover.

The invention, described in relation to a limit or safety switch, also applies to all proximity detectors including terminal blocks or removable switching blocks.

What is claimed is:

1. A proximity detection switching device, comprising:

a sensor component for detecting proximity;

a body comprising a bottom wall defining a plane (P) and a side opposite the bottom wall;

a switching block controlled by the sensor component and comprising connection elements for external connection via a cable;

a housing for locating the switching block;

a removable cover for closing the housing on said side opposite the bottom wall, the body and the cover each having a flange part for cooperatively forming a flange that defines a sealed aperture for a cable to pass therethrough;

first rectilinear guiding and holding means located in the body; and a detachable cable-entry coupling comprising fitting elements for sliding engagement with said first rectilinear guiding and holding means along a direction approximately perpendicular to the plane of the bottom wall of the body.

2. The device according to claim 1, further comprising insertion means having a shape complementing the first rectilinear guiding and holding means and the switching block, wherein the fitting elements of the coupling comprise a frame having sides integral with said insertion means, wherein the device body is configured to receive the switching block and the coupling along a same direction.

3. The device according to claim 2, wherein said insertion means comprises a snap-on fit with said first rectilinear guiding and holding means.

4. The device according to claim 2, wherein said insertion means comprises an interference fit with said first rectilinear guiding and holding means.

5. The device according to claim 1, wherein said removable cover further comprises a second rectilinear guiding and holding means, and the fitting elements comprise a frame located at an end of the coupling and housed partly in the housing of the switching block and partly in said second rectilinear guiding and holding means located in the cover.

6. The device according to claim 1, wherein:

said body further comprises pivoting elements located near one end of the body and a first half flange, the cover further comprises a second half flange and a means for fixing the coyer to the body, the coupling further comprises an external seal housed in the first and second half flanges, and the cover is mounted on a first end of the body by means of said pivoting elements and on a second end of the body by said means for fixing the cover to the body, screw the pivoting elements being offset relative to a plane defined by the cover for increasing a tightening torque of the seal.

7. The device according to claim 6, further comprising grips located in lateral walls of the body, wherein the pivoting elements comprise hooks for engaging said grips.

8. The device according to claim 1, wherein the fitting elements comprise a symmetrical frame.

9. The device according to claim 1, further comprising a bi-injected seal bead located on a periphery of the cover.

* * * * *